US007329064B2

(12) United States Patent
Byun

(10) Patent No.: US 7,329,064 B2
(45) Date of Patent: Feb. 12, 2008

(54) LIQUID COSMETIC CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 0 days.

(21) Appl. No.: 11/384,397

(22) Filed: Mar. 21, 2006

(65) Prior Publication Data

US 2006/0216105 A1 Sep. 28, 2006

(30) Foreign Application Priority Data

Mar. 22, 2005 (KR) ..... 10-2005-0023576

(51) Int. Cl.
*A46B 11/04* (2006.01)
*B43M 11/06* (2006.01)

(52) U.S. Cl. ..... 401/276; 401/278; 401/280; 401/186

(58) Field of Classification Search ..... 401/6, 401/183–186, 268, 270, 276, 278, 280
See application file for complete search history.

(56) References Cited

U.S. PATENT DOCUMENTS 5,678,941 A * 10/1997 Nakajima ..... 401/205
6,412,997 B2 * 7/2002 Berke et al. ..... 401/6

* cited by examiner

*Primary Examiner*—David J. Walczak
(74) *Attorney, Agent, or Firm*—Birch, Stewart, Kolasch & Birch, LLP

(57) ABSTRACT

A liquid cosmetic case includes a discharger (20) which discharges and seals liquid cosmetic by having a brush (30) at the upper side of a tube-shaped container (10), a supporting cap (50) and a cap (60) by forming a non-return valve (40) at one side of the upper part of the tube-shaped container (10). When used, if the tube-shaped container (10) is pressed, only a necessary amount of liquid cosmetic is discharged through the discharger (10) for easy use, and if the press is released by the non-return valve (40) formed at one side of the tube-shaped container (10), as the valve hole (41) formed at the non-return valve (40) is opened and closed, the air flows into the tube-shaped container (10) or the air is blocked, so that the contraction and the restoration of the tube-shaped container (10) can be done easily, making the repeated presses of the tube-shaped container (10) easy and the use of liquid cosmetic easy.

2 Claims, 5 Drawing Sheets

LIQUID COSMETIC CASE

CROSS-REFERENCE TO RELATED APPLICATIONS

This application claims the benefit of Korean Patent Application No. 10-2005-0023576, filed on Mar. 22, 2005, in the Korean Intellectual Property Office, the disclosure of which is incorporated herein by reference.

BACKGROUND

1. Field of the Invention

The present invention relates to a liquid cosmetic case in which the upper side of a tube-shaped container includes a brush. Liquid cosmetic is discharged from the upper side, a sealing-structured discharger is coupled, and at the same time, a cap is coupled in a way that a non-return valve is formed at one side of the upper part of the tube-shaped container. If the tube-shaped container is pressed, a necessary amount of liquid cosmetic is discharged through a discharger for easy use. When the pressing on the tube-shaped container is released the non-return valve formed at one side of the tube-shaped container makes it easy for the tube-shaped container to be restored to its original shape. Thus, a user can easily press the container repeatedly, and easily discharge and use the liquid cosmetic.

2. Discussion of Related Art

According to a conventional art, a liquid cosmetic container includes a brush. A user can make up through the direct discharge to the brush of the liquid cosmetic saved in the tube-shaped container by pressing and releasing the tube-shaped container. But in this kind of liquid cosmetic container, the tube-shaped container is often pressed carelessly, and the liquid cosmetic leaks, so that it is not easy to carry or to safely keep them.

Also, in order to solve the above disadvantages, a different cosmetic container has been used. The inside of the opening formed at the upper part of the tube-shaped container saving liquid includes a brush. A discharger formed by a liquid guiding passage and a discharge hole is coupled, so that when the tube-shaped container is pressed, the discharger goes up, then liquid cosmetic is discharged to the brush side through the liquid guiding passage and the discharge hole, making it possible for a user to make up. When the container is released, the discharger goes down, so that the air flows into the inside of the tube-shaped container, and the pressed container is restored. And as the press and the release are repeated, the discharger goes up and down, and the opening is opened and closed, so that only a necessary amount of liquid cosmetic contained in the tube-shaped container is discharged for use.

However, this liquid cosmetic container is inconvenient in that as the discharge of liquid cosmetic through the liquid guiding passage and the discharge hole formed at the discharger is repeated, the liquid cosmetic can be stuck on the liquid guiding passage or the discharge hole or even can block the passage, then the contracted tube-shaped container cannot be restored to the original state, and the press and the release cannot be done easily so that a user cannot easily make up.

SUMMARY OF THE INVENTION

In order to solve the above-described problems, it is an object of the present invention to provide a cosmetic case in which a discharger with a brush is coupled on the opening formed at the central upper part of a tube-shaped container, and a non-return valve is formed at one upper side of the tube-shaped container along with the coupled cap, so that when pressed, only a necessary amount of liquid cosmetic is discharged through the discharger for easy use and at the same time, when the pressing at the tube-shaped container is released, the non-return valve formed at one side of the tube-shaped container makes the tube-shaped container to be easily restored, so that the pressing on the tube-shaped container can be easily repeated, and the liquid cosmetic is easily discharged for convenient use.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Hereinafter, preferred embodiments of the present invention will be described with reference to the accompanying drawings.

Figure 1:
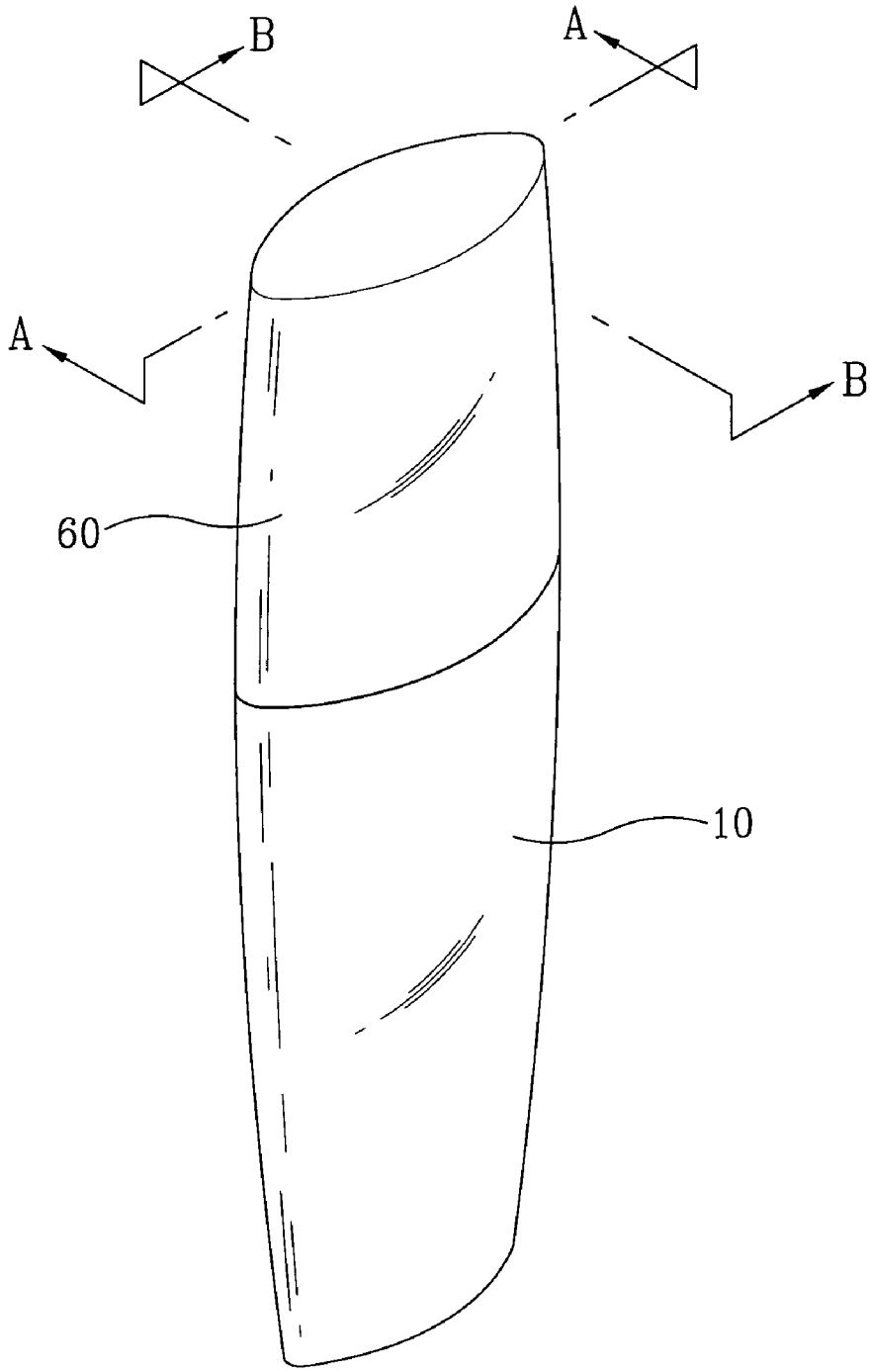
FIG. 1 is a perspective view of a cosmetic case according to the present invention.
Figure 2:
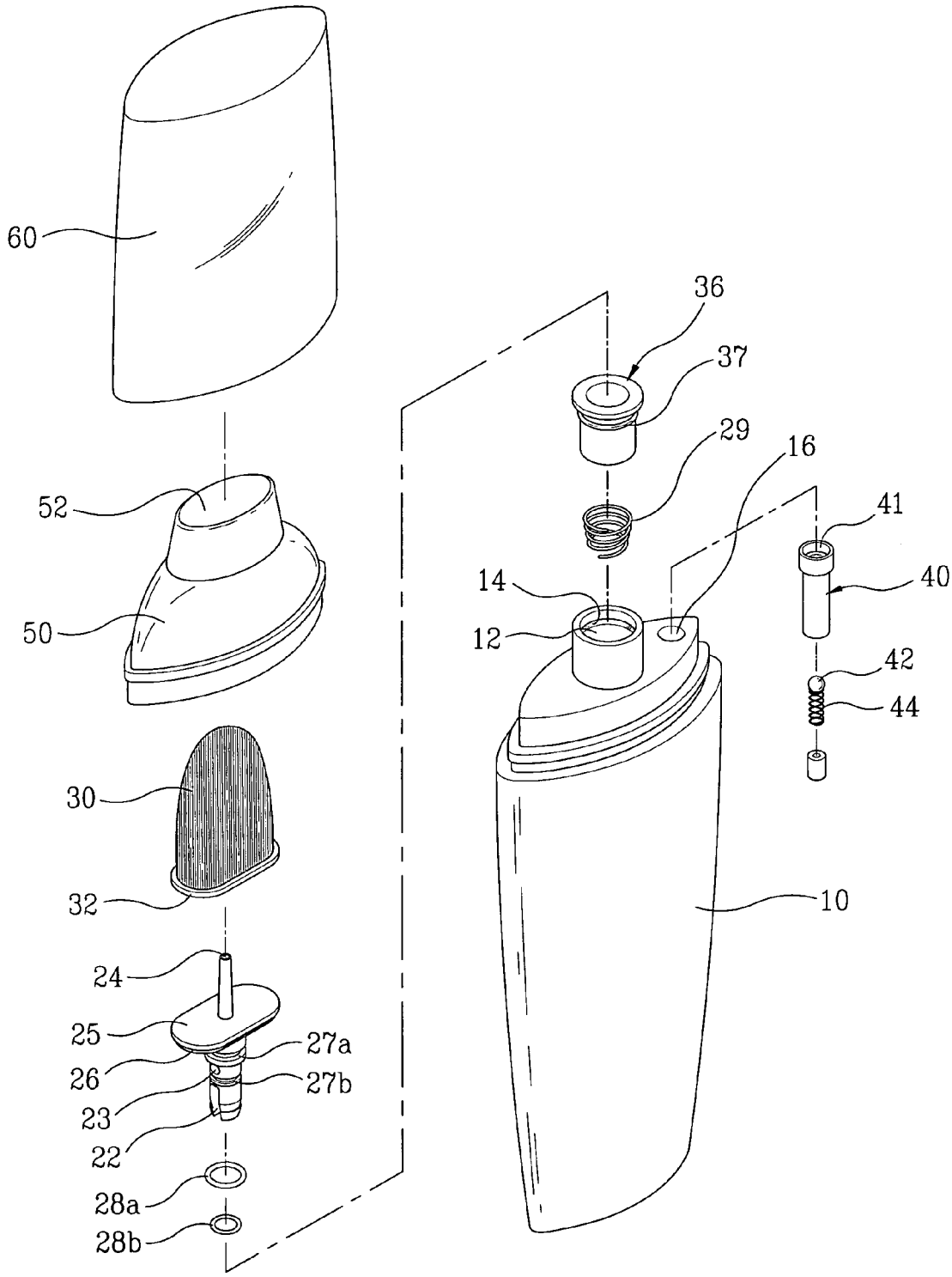
FIG. 2 is an exploded perspective view of the cosmetic case according to the present invention.
Figure 3:
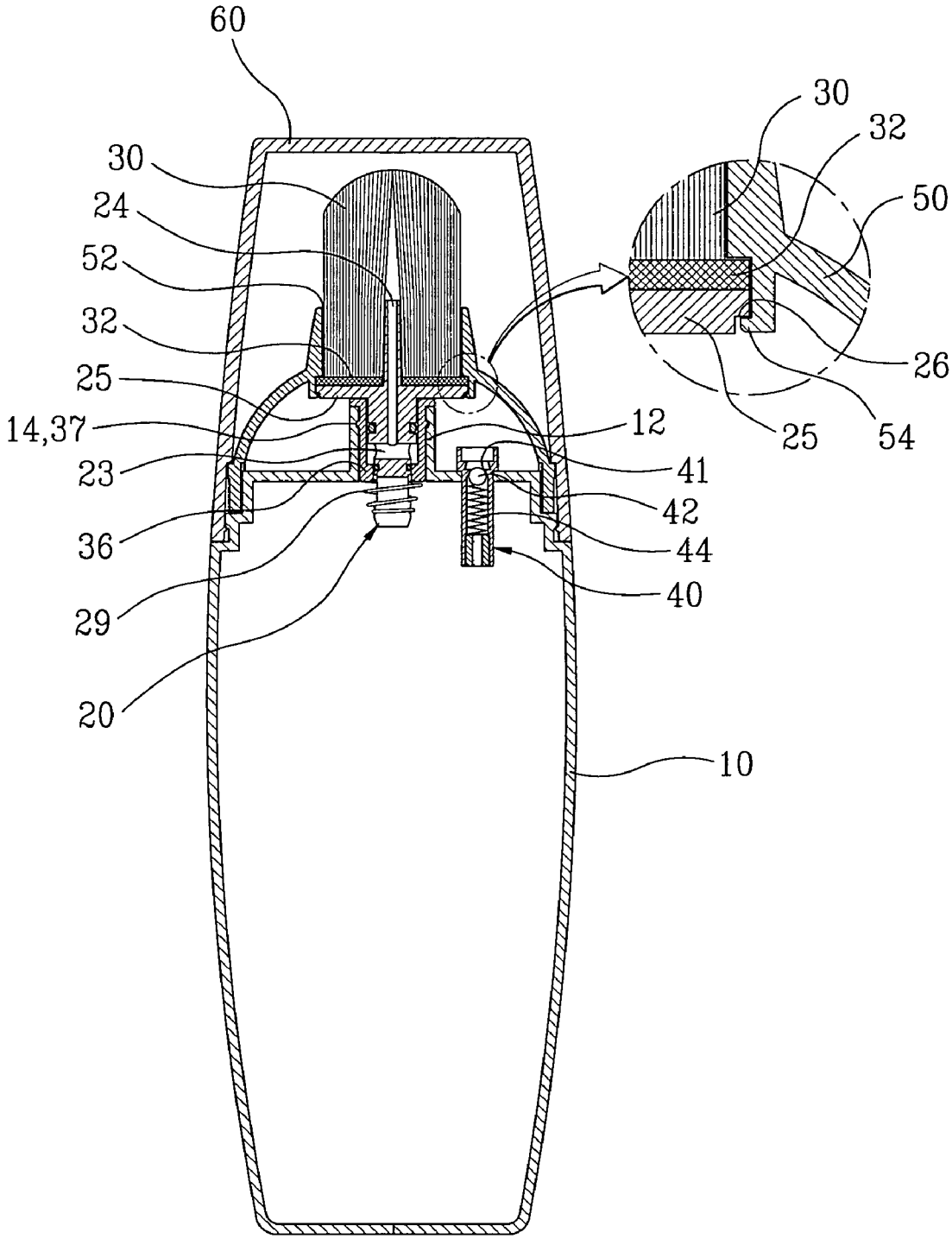
FIG. 3 is a sectional view by A-A line of the cosmetic case according to the present invention.
Figure 4:
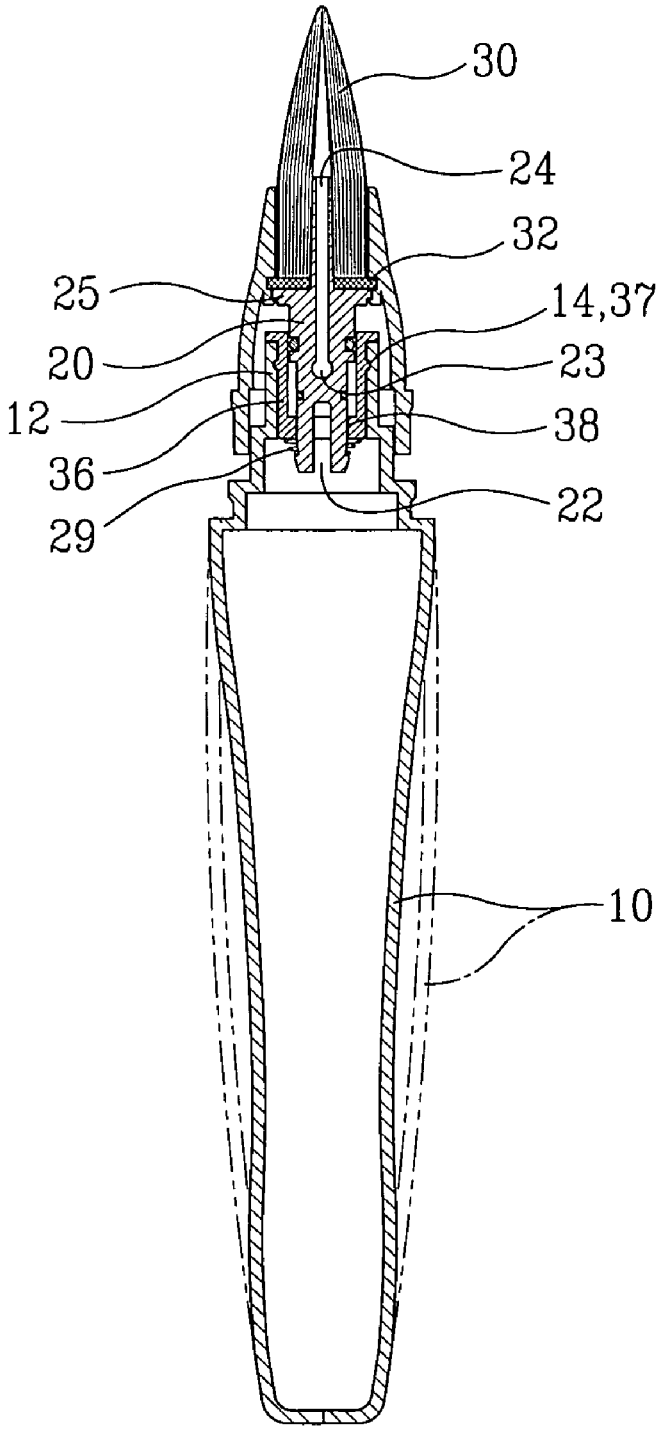
FIG. 4 is a sectional view by B-B line in the state a tube-shaped container is pressed according to the present invention.
Figure 5:
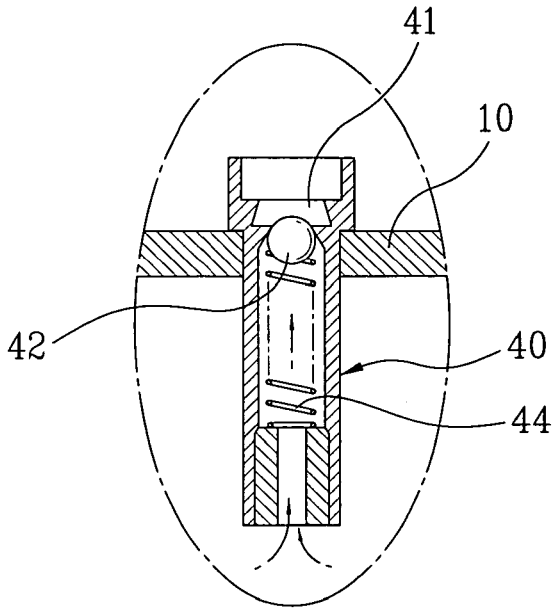
FIG. 5 is a sectional view of a non-return valve in the state a tube-shaped container is pressed according to the present invention.
Figure 6:
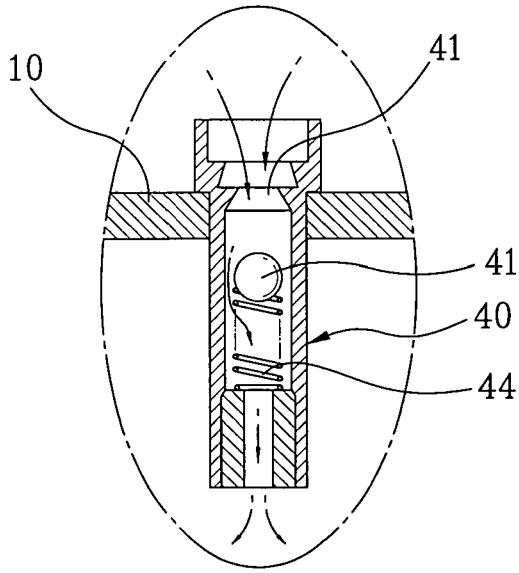
FIG. 6 is a sectional view of a non-return valve in the state the pressure on a tube-shaped container is released according to the present invention.

FIG. 1 is a perspective view of a cosmetic case according to the present invention, FIG. 2 is an exploded perspective view of the cosmetic case according to the present invention, FIG. 3 is a sectional view by A-A line of the cosmetic case according to the present invention, FIG. 4 is a sectional view by B-B line in the state a tube-shaped container is pressed according to the present invention, FIG. 5 is a sectional view of a non-return valve in the state a tube-shaped valve is pressed according to the present invention, and FIG. 6 is a sectional view of a non-return valve in the state the pressure on a tube-shaped valve is released according to the present invention.

According to the present invention, an opening 12 formed at the central upper part of a tube-shaped container 10 is coupled with a discharger 20 with a brush 30, and at the same time, a non-return valve 40 is formed at one side of the upper part of the tube-shaped container 10 along with a supporting cap 50 and a cap 60, so that liquid cosmetic is discharged through the discharger 20 for easy use, and at the same time, the tube-shaped container 10 is easily pressed and released by the non-return valve 40 formed at one side of the tube-shaped container 10.

The present invention can be explained in detail referring to the accompanying drawings.

Referring to FIG. 1 and FIG. 2, an opening 12 along with an inner locking wheel 14 are formed in the upper side of a tube-shaped container 10, and a discharger 20 coupled with a brush 30 and a fixing support 36 is formed inside the opening 12.

A divided opening 22 is formed at the lower side of the discharger 20, and by horizontally putting a liquid guiding passage 23 at the central side, the liquid guiding passage 23 is connected with a discharge hole 24 which extends to the upper side of the central part. A fixing plate 25 is formed along with a step wheel 26.

Also, upper and lower grooves 27*a* 27*b* are formed from the upper part of the circumference part of the discharger 20, and the upper and the lower sealing O-rings 28*a* 28*b* are interposed.

Also, a brush plate 32 with the brush 30 is closely coupled at the upper side of the fixing plate 25 where the step wheel is formed. And an outer protrusion wheel 37 is formed at the lower side of the fixing support 36, an inner ring-shaped step 38 passes through the inner side of the fixing support 36, and a spring 29 is inserted at the lower side of the protruded discharger 20 for fixing.

As described above, by connecting the discharger 20 including the brush 30 and the fixing support 36 at the lower side to the inside of the opening 12 where the tube-shaped container 10 is formed at the upper side, the discharger 20 is safely connected, and the outer protrusion wheel 37 formed at the outer circumference part of the fixing part 36 coupled at the lower circumference part of the discharger 20 does not break away by not being caught at the inner locking wheel formed at the upper side of the inner circumference wall of the opening 12.

On the other hand, a hole 16 is formed at one side of the upper side of the tube-shaped container 10, and a non-return valve is connected, opening and closing the valve hole 41 by a ball 42 and a spring 44.

As described above, the supporting cap 50 is formed at the upper side of the tube-shaped container 10 where the discharger 20, the brush 30 and the non-return valve 40 are coupled. The brush 30 penetrates a central hole 52 in the supporting cap 50 at the upper side of the discharger 20 coupled at the opening 12 of the tube-shaped container 10. The supporting cap 50 includes the locking step wheel 54 formed at the lower side of the central hole 52. As described in FIG. 3, the locking step wheel 54 is locked at the locking wheel 26 formed at the circumference of the fixing plate 25, so that the brush plate 32 and the fixing plate 25 are held closely with each other, and the discharger 20 and the supporting cap 50 are unified. And the cap 60 is coupled at the upper side of the supporting cap 50.

Referring to FIG. 4, by pressing the tube-shaped container 10 by hand, the discharger 20 goes up by the pressure of the liquid cosmetic contained in the tube-shaped container 10, then the inner ring-shaped step 38 is opened, then the inner side of tube-shaped container 10 is connected with the divided opening 22, the liquid guiding passage 23 and the discharge hole 24 forming the discharger, then the liquid cosmetic contained in the tube-shaped container 10 is discharged to the discharge hole 24 and then to the brush 30.

At this point, when the discharger 20 goes up by the pressure of the tube-shaped container 10, the spring 29 formed at the circumference of the divided opening 22 blocks the excessive rise of the discharger 20.

As described above, after the use of the liquid cosmetic, when the pressing of the tube-shaped container 10 is released, the discharger 20 including the brush 30 goes down by the spring 29, and as described in FIG. 3, the lower sealing 0-ring 28*b* seals the inner ring-shaped step 38, then the divided opening 22, the liquid guiding passage 23 and the discharge hole 24 of the discharger 20 are closed.

Also, the upper sealing O-ring 28*a* interposed at the upper groove 27*a* of the circumference part of the discharger 20 blocks the leakage of liquid cosmetic through the fixing support 36 when the liquid cosmetic discharged to the liquid guiding passage 23 and the discharge hole 24 through the divided opening 22 as the inner ring-shaped step 38 is opened as the discharger goes up by the pressure of the tube-shaped container 10.

As described above, the upper and lower sealing O-rings 28*a* 28*b* interposed at the upper and the lower grooves 27*a* 27*b* at the circumference part of the discharger 20 should be safely carried and kept, avoiding the leakage of the liquid cosmetic contained in the tube-shaped container 10 by sealing the inner part of the fixing support 36.

On the other hand, the hole 16 is formed at one side of the upper part of the tube-shaped container 10, and the non-return valve 40 opening and closing the valve hole 41 by the ball and the spring 44 is coupled. When the tube-shaped container 10 is pressed, as described in FIG. 5, the ball goes up, then the valve hole 41 is closed, and when the press on the tube-shaped container 10 is released, as described in FIG. 6, the ball 42 goes down by the absorption force absorbed by the expansive force of the tube-shaped container 10, then the valve hole 41 formed at the non-return valve 40 is opened, then the air flows into the tube-shaped container, making the restoration of the tube-shaped container 10 easy.

As described above, despite repeated presses on the tube-shaped container 10 by the non-return valve 40 formed at one side of the upper part of the tube-shaped container, the contraction and the restoration of the tube-shaped container 10 become easy, making the press of the tube-shaped container 10 easy, so a user can use liquid cosmetic easily.

As described above, the discharger including the brush is coupled at the opening formed at the central upper part of the tube-shaped container, and at the same time, the non-return valve is formed at one side of the upper part of the tube-shaped container along with the cap, so that when the tube-shaped container is pressed, only a necessary amount of liquid cosmetic is discharged through the discharger, and when the press on the tube-shaped container is released, as the valve hole formed at the non-return valve is opened and closed, the air flows in and is blocked, which makes the restoration of the tube-shaped container easy, so that the discharge and the use of the liquid cosmetic by the repeated presses become easy.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A liquid cosmetic case comprising a tube-shape container, a discharger having a brush at an opening and a cap, wherein the opening having an inner locking wheel is formed at a central upper part of the tube-shaped container, and a hole is formed at one side, wherein the brush is coupled at the opening and the discharger is coupled at a lower circumference part along with a fixing support, wherein a supporting cap and the cap are connected at the upper part of the tube-shaped container coupled with a non-return valve at the hole, wherein a divided opening is formed at the lower part of the discharger, and connected with a discharge hole horizontally penetrating to the upper side of the central part, wherein upper and lower grooves are formed at a circumference part, then upper and lower sealing O-rings are interposed, wherein an outer protrusion wheel is formed by the fixing support, and wherein an inner ring-shaped step is penetrated to the inner side of the fixing support to be protruded at the lower side.

2. The liquid cosmetic case as claimed in claim 1, wherein the non-return valve coupled at the hole formed at one side of the upper part of the tube-shaped container comprises a ball and a spring and opens and closes a valve hole.

* * * * *